US008753149B2

(12) United States Patent
Lee

(10) Patent No.: US 8,753,149 B2
(45) Date of Patent: Jun. 17, 2014

(54) UNIVERSAL PLUG ADAPTOR

(75) Inventor: Chiu-San Lee, New Taipei (TW)

(73) Assignee: XYZ Science Co., Ltd., New Taipei (TW)

( * ) Notice: Subject to any disclaimer, the term of this patent is extended or adjusted under 35 U.S.C. 154(b) by 99 days.

(21) Appl. No.: 13/480,496

(22) Filed: May 25, 2012

(65) Prior Publication Data

US 2013/0316589 A1 Nov. 28, 2013

(51) Int. Cl.
*H01R 25/00* (2006.01)

(52) U.S. Cl.
USPC ..... 439/653

(58) Field of Classification Search
USPC ..... 439/653, 137, 138, 105, 106
See application file for complete search history.

(56) References Cited

U.S. PATENT DOCUMENTS

| | | | | | |
|---|---|---|---|---|---|
| 2,494,122 | A * | 1/1950 | Gubing | 337/59 |
| 3,800,110 | A * | 3/1974 | Baumanis | 200/458 |
| 3,810,070 | A * | 5/1974 | Ludwig | 439/145 |
| 3,914,566 | A * | 10/1975 | Wendling | 200/61.27 |
| 5,020,997 | A * | 6/1991 | Calderara et al. | 439/137 |
| 5,044,969 | A * | 9/1991 | Richier | 439/188 |
| 5,626,495 | A * | 5/1997 | Drewnicki | 439/651 |
| 5,702,259 | A * | 12/1997 | Lee | 439/137 |
| 5,836,777 | A * | 11/1998 | Chen | 439/222 |
| 5,919,060 | A * | 7/1999 | Lee | 439/518 |
| 5,941,724 | A * | 8/1999 | Reed | 439/346 |
| 5,998,735 | A * | 12/1999 | Patterson, Jr. | 174/67 |
| 6,010,347 | A * | 1/2000 | Lee | 439/222 |
| 6,247,941 | B1 * | 6/2001 | Lee et al. | 439/105 |
| 6,328,581 | B1 * | 12/2001 | Lee et al. | 439/106 |
| 6,592,406 | B2 * | 7/2003 | Liu | 439/620.31 |
| 6,615,859 | B2 * | 9/2003 | Sato et al. | 137/15.14 |
| 6,786,744 | B1 * | 9/2004 | Lee | 439/137 |
| 6,932,631 | B2 * | 8/2005 | Huang | 439/145 |
| 6,991,482 | B1 * | 1/2006 | Liao | 439/166 |
| 7,168,969 | B1 * | 1/2007 | Wang | 439/173 |
| 7,422,452 | B2 * | 9/2008 | Achtner et al. | 439/106 |
| 7,445,472 | B1 * | 11/2008 | Huang et al. | 439/138 |
| 7,445,513 | B1 * | 11/2008 | Lee | 439/652 |
| 7,527,508 | B1 * | 5/2009 | Lee et al. | 439/137 |
| 7,632,119 | B1 * | 12/2009 | Ma et al. | 439/172 |
| 7,753,700 | B2 * | 7/2010 | Ma | 439/133 |
| 7,857,640 | B1 * | 12/2010 | Lee et al. | 439/137 |
| 7,889,464 | B2 * | 2/2011 | Chen et al. | 361/42 |
| 8,142,208 | B2 * | 3/2012 | Ruffner | 439/105 |
| 8,197,265 | B1 * | 6/2012 | Lee et al. | 439/105 |
| 8,382,493 | B2 * | 2/2013 | Ruffner | 439/105 |
| 2011/0059623 | A1 * | 3/2011 | Capece et al. | 439/39 |

* cited by examiner

*Primary Examiner* — Amy Cohen Johnson
*Assistant Examiner* — Vladimir Imas
(74) *Attorney, Agent, or Firm* — Leong C. Lei

(57) ABSTRACT

The universal plug adaptor contains a face plate and a casing joined to the face plate. The casing contains a first track element, a terminal set, two platform elements, and a first sliding element in the casing. Each platform element has a first limiting piece for locking the first sliding element when it is pressured from a side. The platform elements, the first tack element, and the first sliding element engage with each other. The universal plug adaptor is able to prevent the hazard when only a prong is inserted and a prong is left outside the universal plug adaptor, and the first ground piece allows proper grounding to plugs conforming to German and French specifications.

7 Claims, 17 Drawing Sheets

UNIVERSAL PLUG ADAPTOR

(a) TECHNICAL FIELD OF THE INVENTION

The present invention is generally related to universal plug adaptors, and more particularly to a universal plug adaptor capable of receiving German and French plugs and preventing the hazard when only a prong is inserted.

(b) DESCRIPTION OF THE PRIOR ART

Various types of electrical plugs and sockets are used by different countries. Therefore, there are so-called universal plug adaptors for people travelling between different countries. The main requirements for these universal plug adaptors are convenience, small form factor, and usage safety. However; for most of the universal plug adaptors, the conducting copper-plate terminals in the holes for live (L) and neutral (N) pins are usually exposed. Even though some universal plug adaptors do provide a cover for the holes, the cover can be easily opened and as such they can only be considered dust-proof and has little effect in providing safety. Especially, most of them do not support Brazilian plugs having pins of diameters 4.8 mm and 4.0 mm. Additionally, these universal plug adaptors do not conform to the grounding required by German and French specifications, which is a problem for more than 20 years.

SUMMARY OF THE INVENTION

A major objective of the present invention is to prevent the hazard when only a prong is inserted and a prong is left outside the universal plug adaptor.

Another objective of the present invention is to provide a first ground piece so as to conform to plugs of German, French, China, Australia 16A, U.S. 15A, and Brazil specifications.

Yet another objective of the present invention is to conform to the polarity of a plug of the Swiss specification.

To achieve these objectives, a universal plug adaptor of the present invention contains a face plate and a casing joined to the face plate. The casing contains a first track element, a terminal set, two platform elements, and a first sliding element in the casing. Each platform element is forwardly extended with a first limiting piece for locking the first sliding element when it is pressured from a side. The platform elements, the first tack element, and the first sliding element engage with each other. The casing further contains a side member configured to a side inside the casing, and the side member has a terminal set, a second track element, and a second limiting piece. The second track element is slidably configured with at least a second sliding element.

As described above, when an object is inserted into one of the plug holes of the face plate, the first sliding element is pressured only from a side and the first sliding element engages with the first limiting piece on a platform element to prevent electric shock. Only when a plug is properly plugged into the face plate, the first sliding element is balanced and slides along the first track element. The prongs of the plug are then in contact with the terminal set. Additionally, the side member provides an additional plug capacity, and the first ground piece allows proper grounding to plugs conforming to German, French, and Brazil specifications, and proper polarity arrangement for Swiss plugs.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
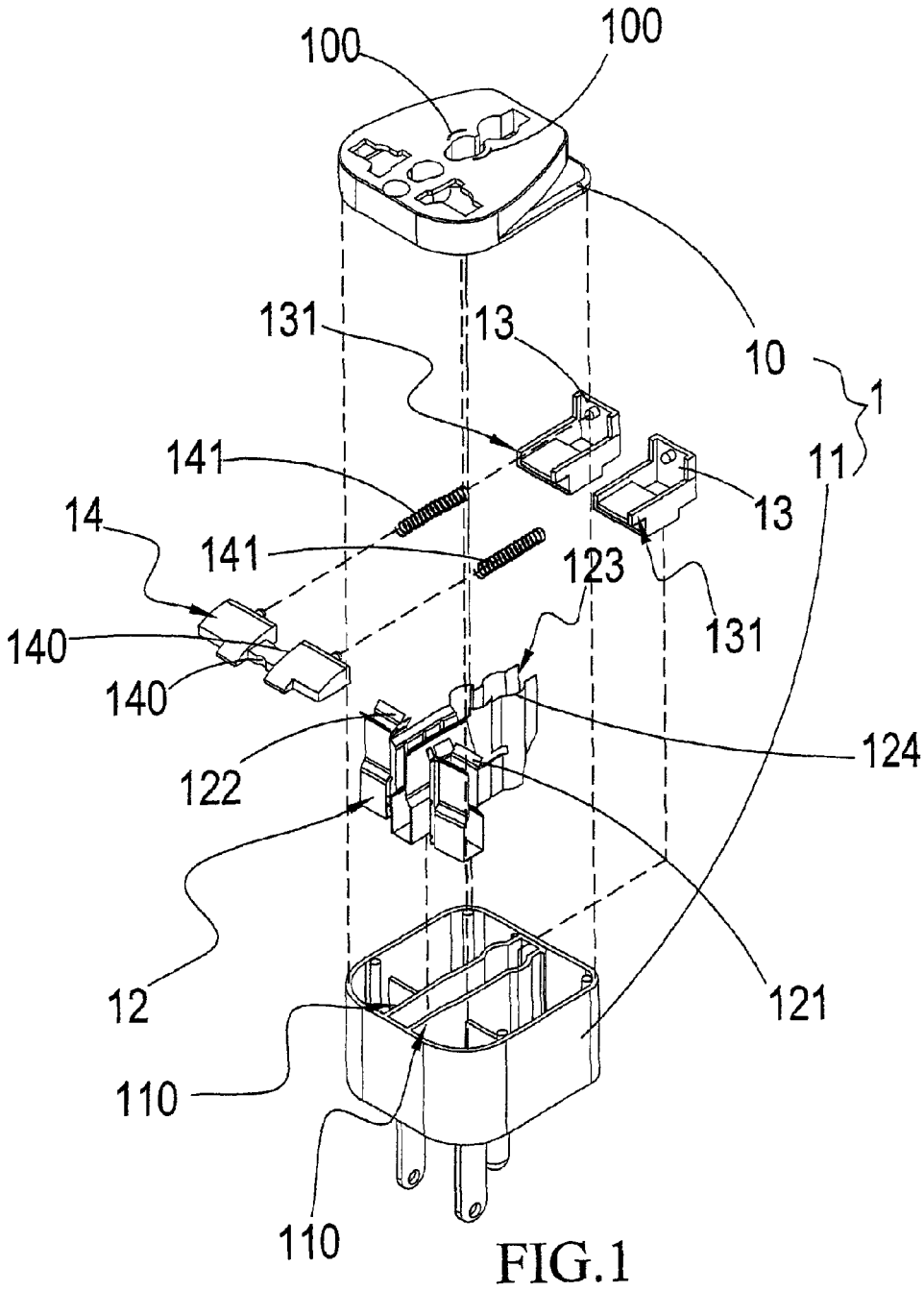
FIG. 1 is a perspective break-down diagram showing the various components of a universal plug adaptor according to an embodiment of the present invention.
Figure 2:
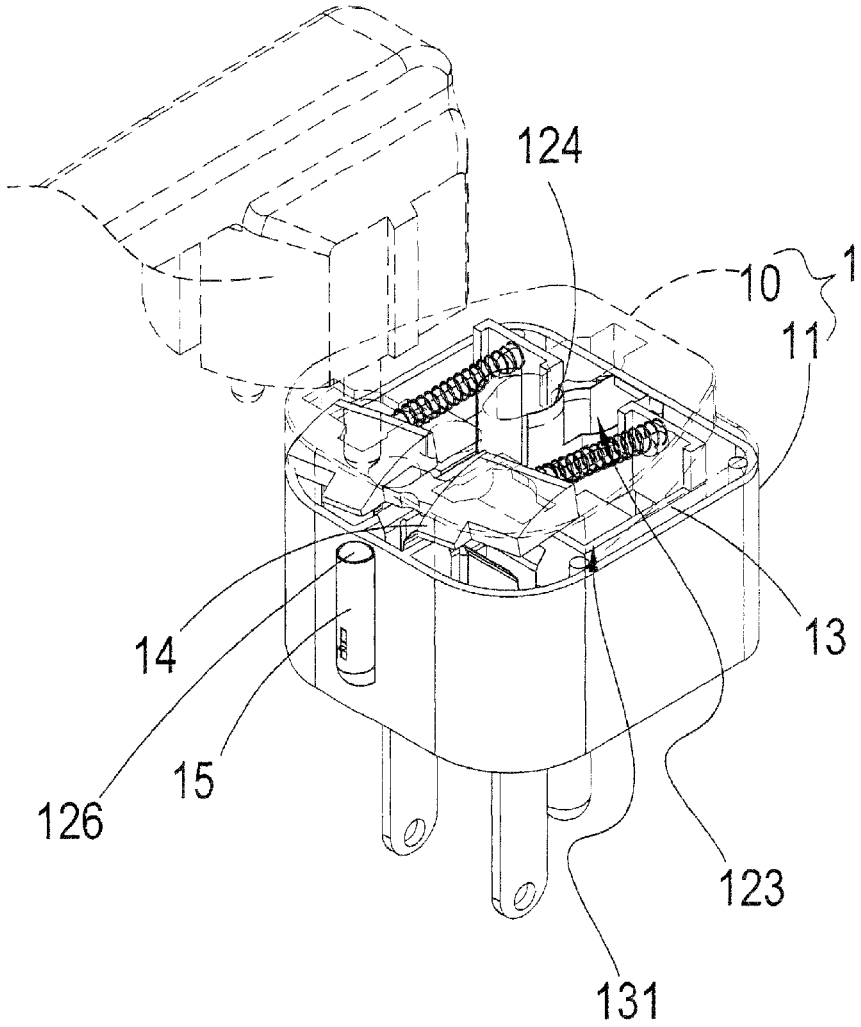
FIG. 2 is a perspective diagram showing a plug not properly plugged into the universal plug adaptor of FIG. 1.
Figure 3:
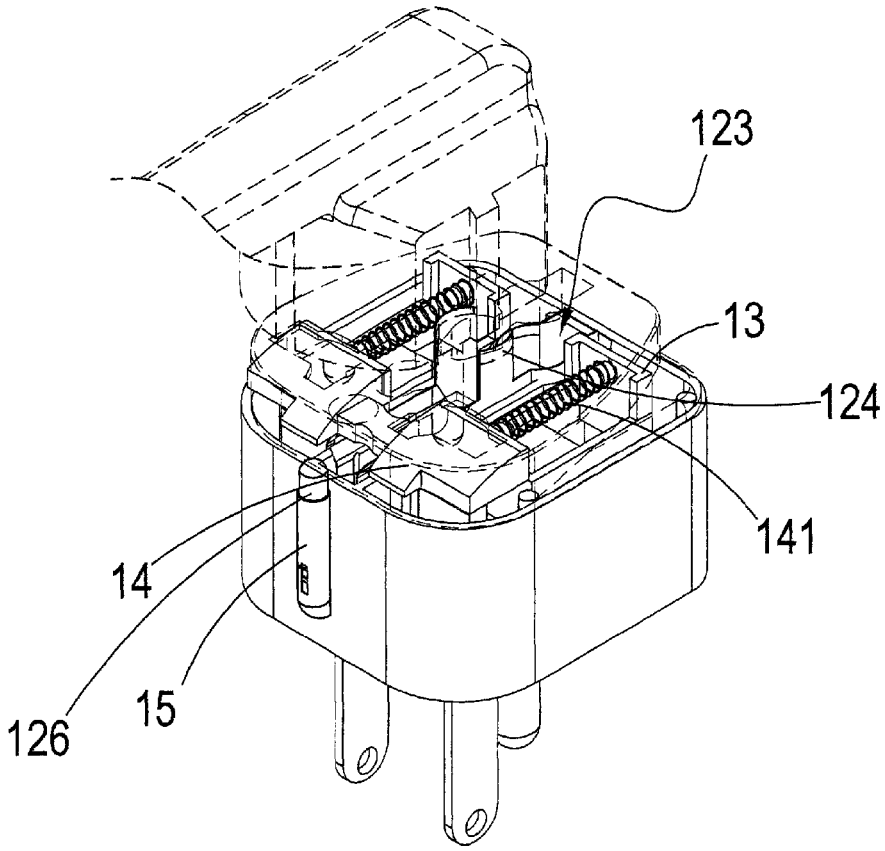
FIG. 3 is a perspective diagram showing a plug properly plugged into the universal plug adaptor of FIG. 1.
Figure 4:
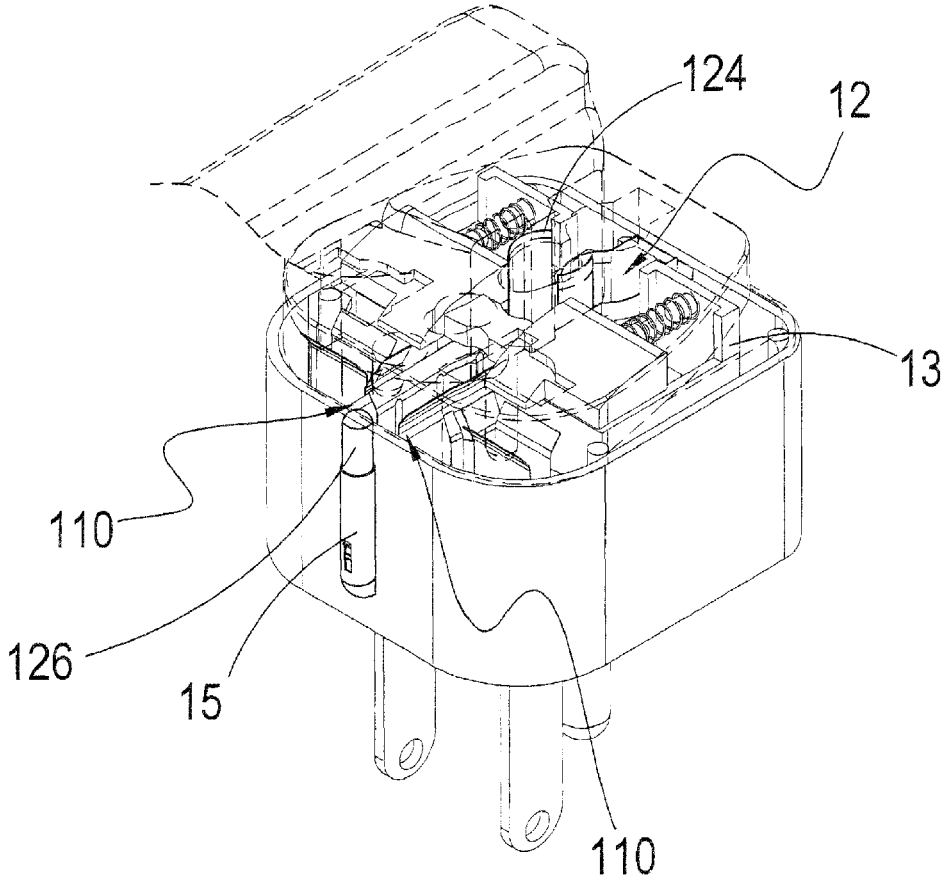
FIG. 4 is a perspective diagram showing the plug of FIG. 3 completely plugged into the universal plug adaptor of FIG. 1.
Figure 4A:
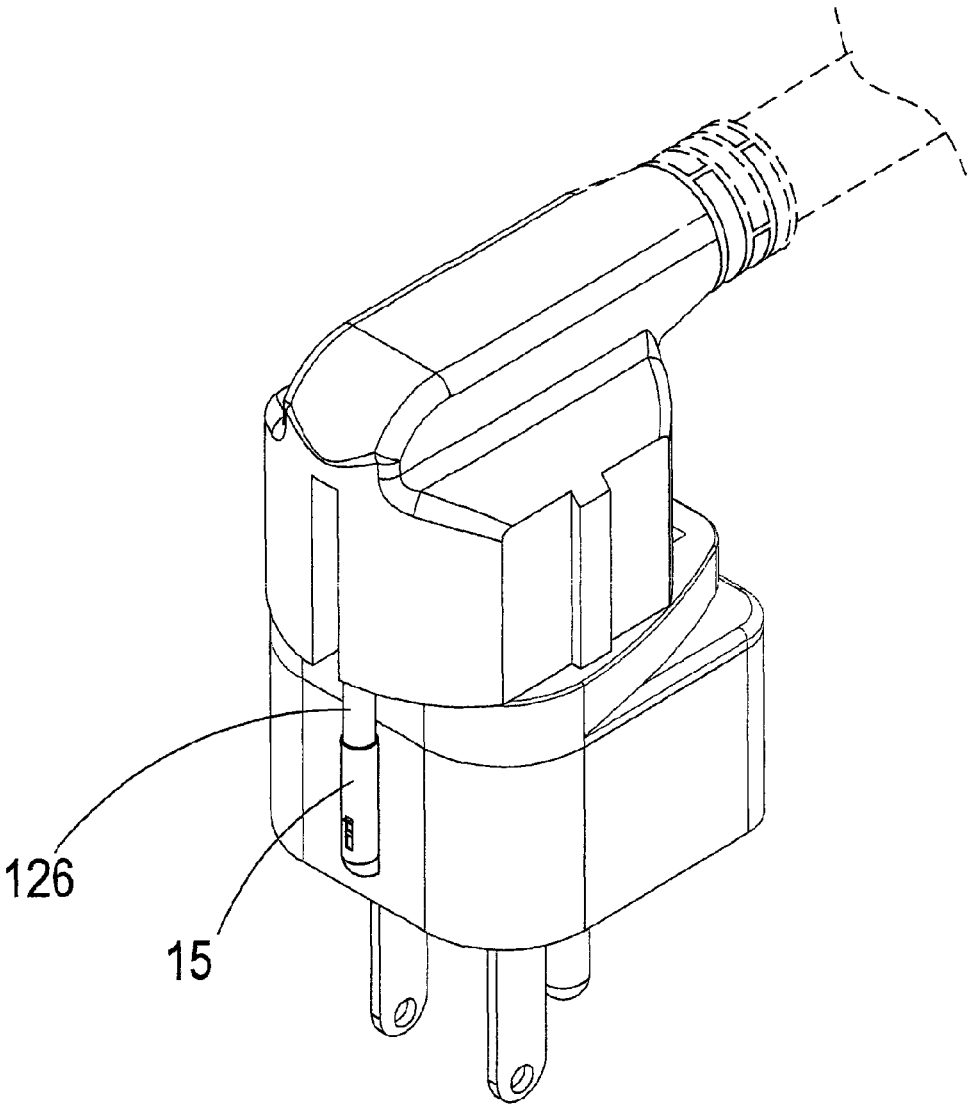
FIG. 4A is a perspective diagram showing the outside appearance of the plug and the universal plug adaptor of FIG. 4.
Figure 4B:
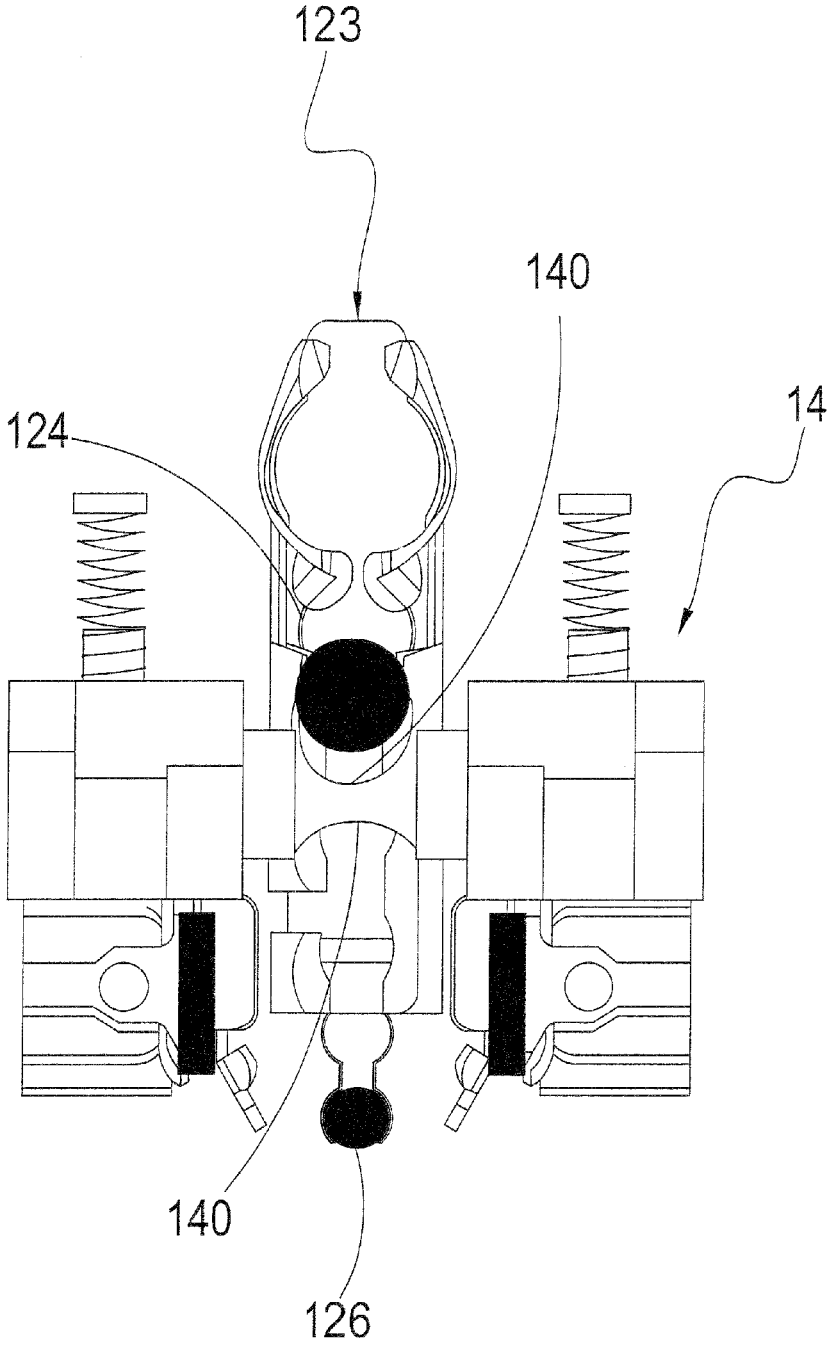
FIGS. 4B to 4H are schematic diagrams showing the interaction of the plugs conforming to various specifications with the universal plug adaptor of FIG. 1.
Figure 4C:
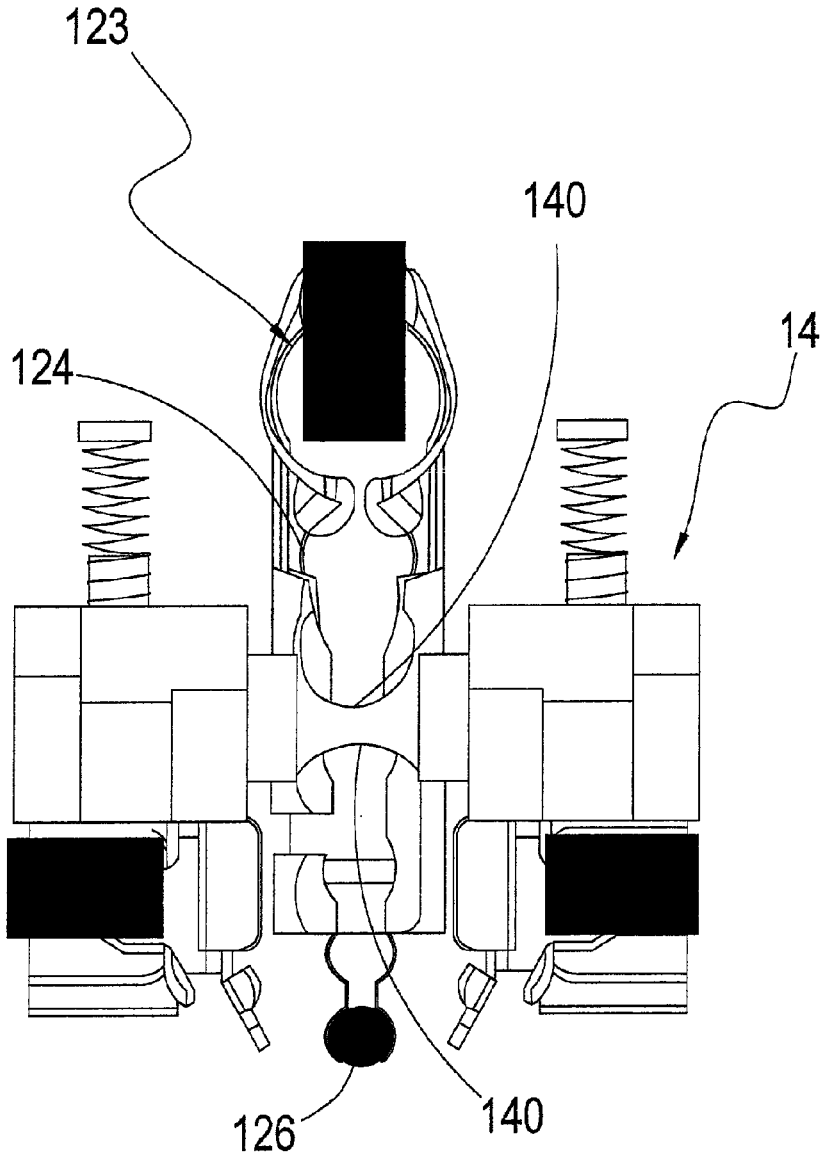
Figure 4D:
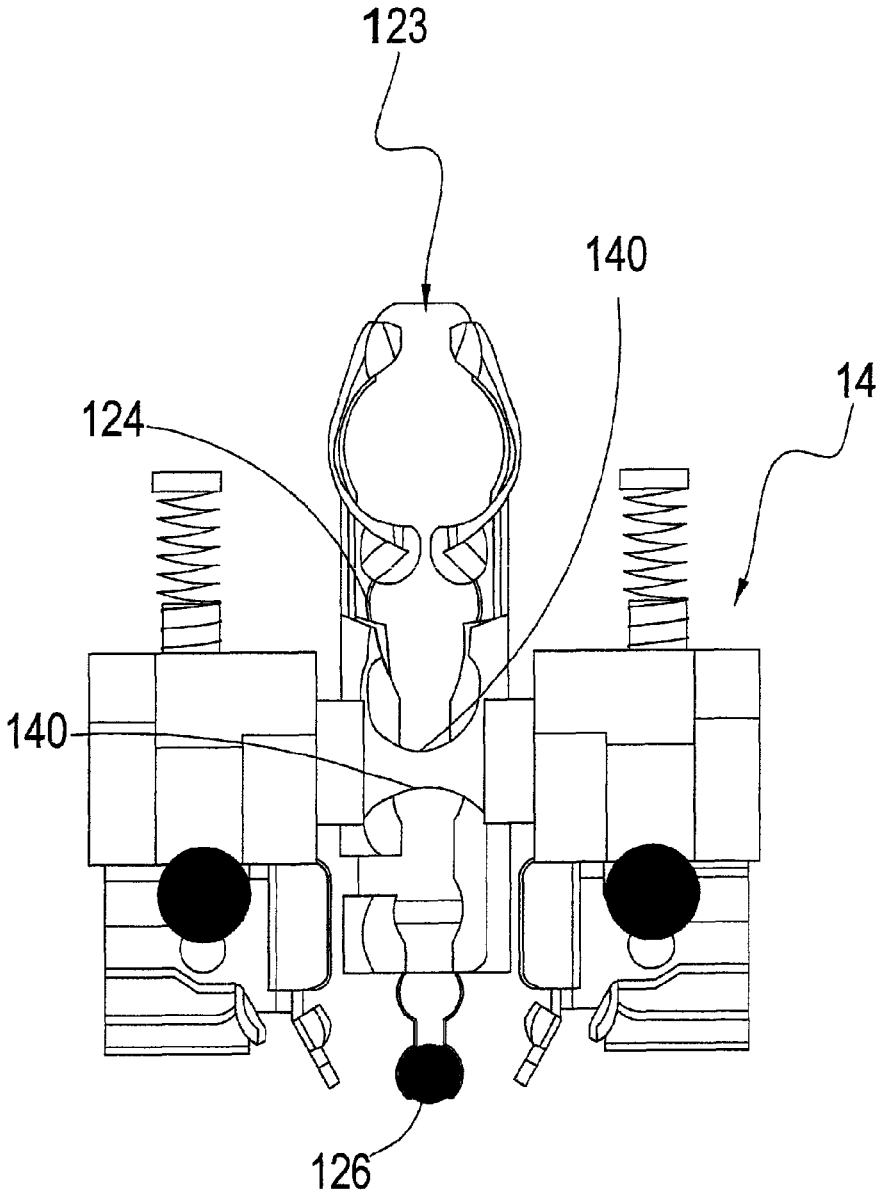
Figure 4E:
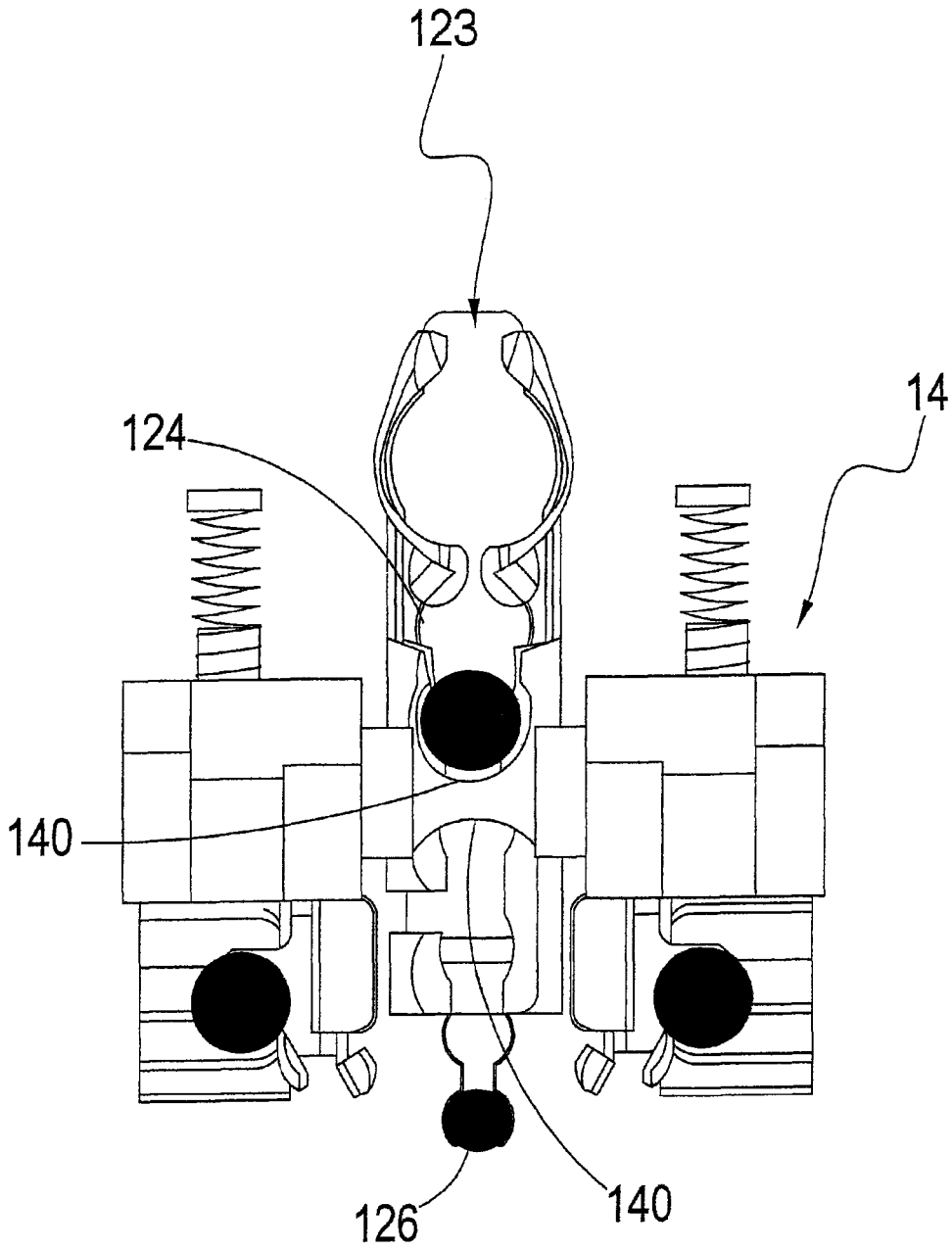
Figure 4F:
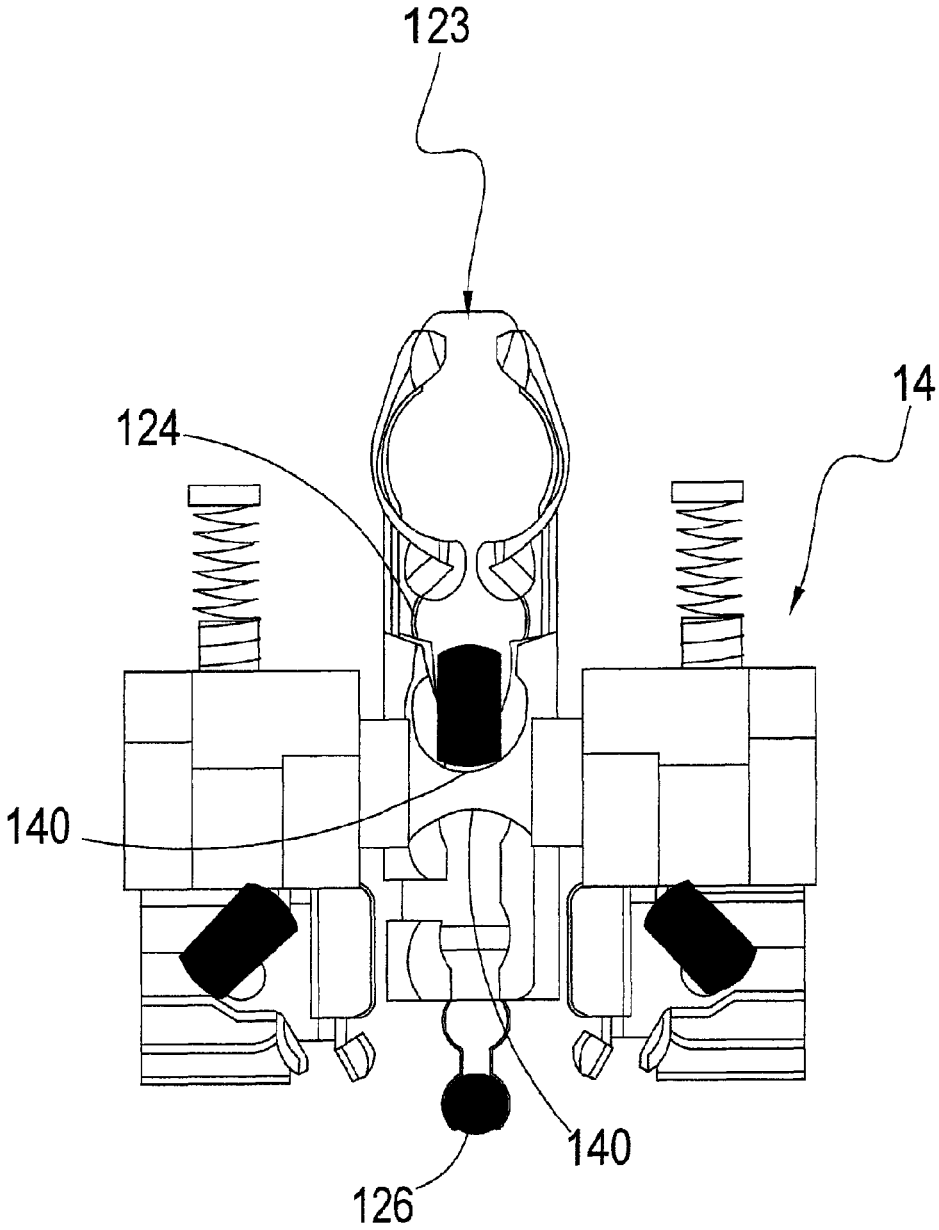
Figure 4G:
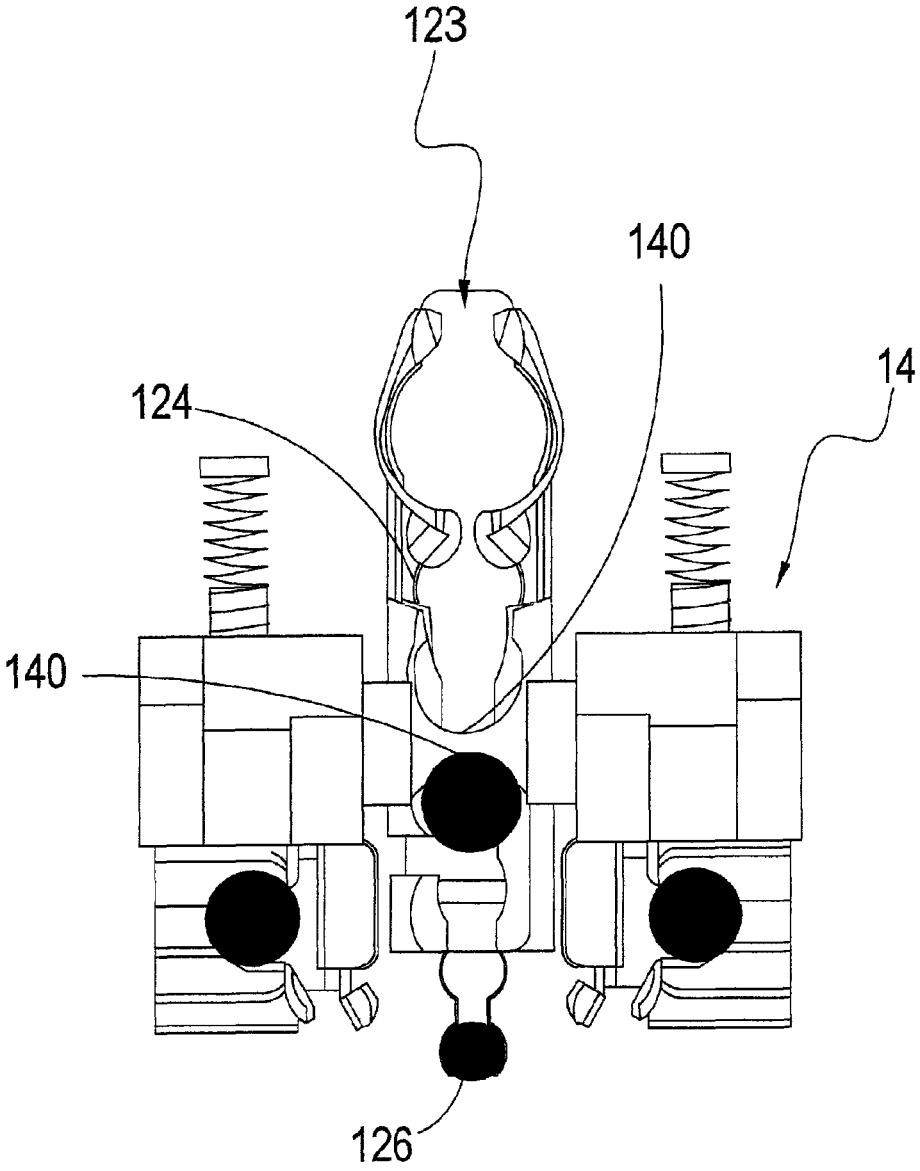
Figure 4H:
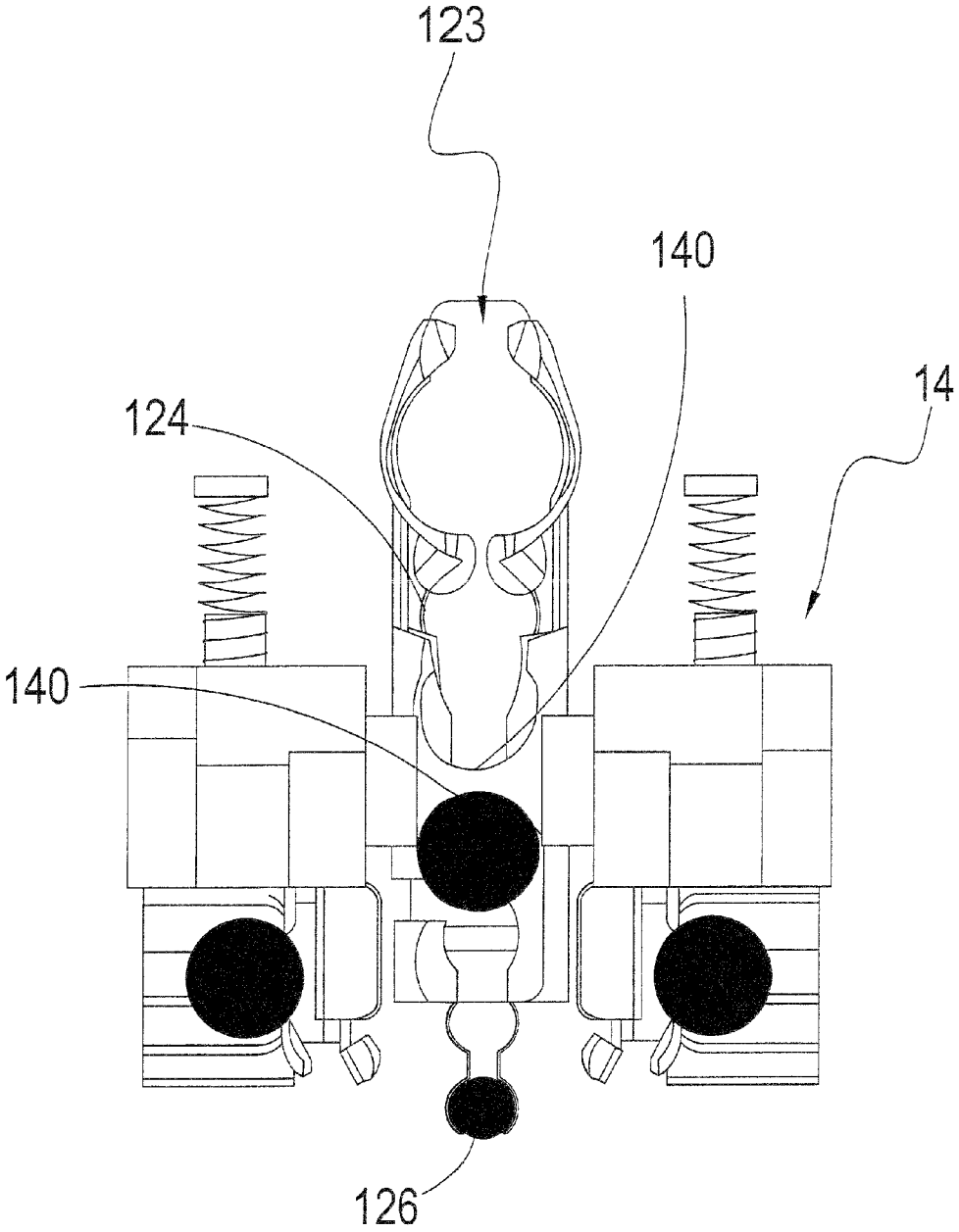
Figure 5:
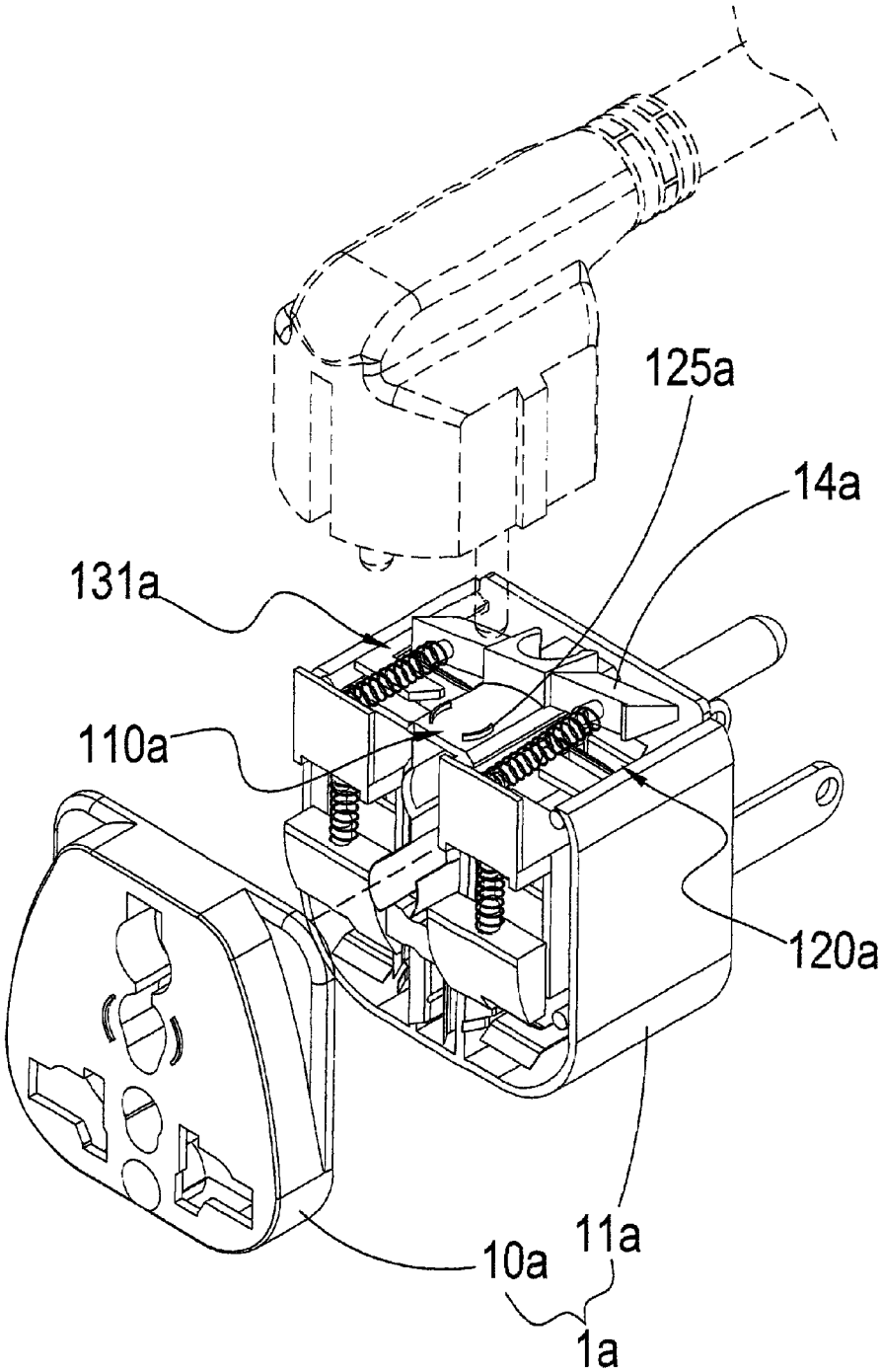
FIG. 5 is a perspective diagram showing a plug not properly plugged into a universal plug adaptor according to another embodiment of the present invention.
Figure 6:
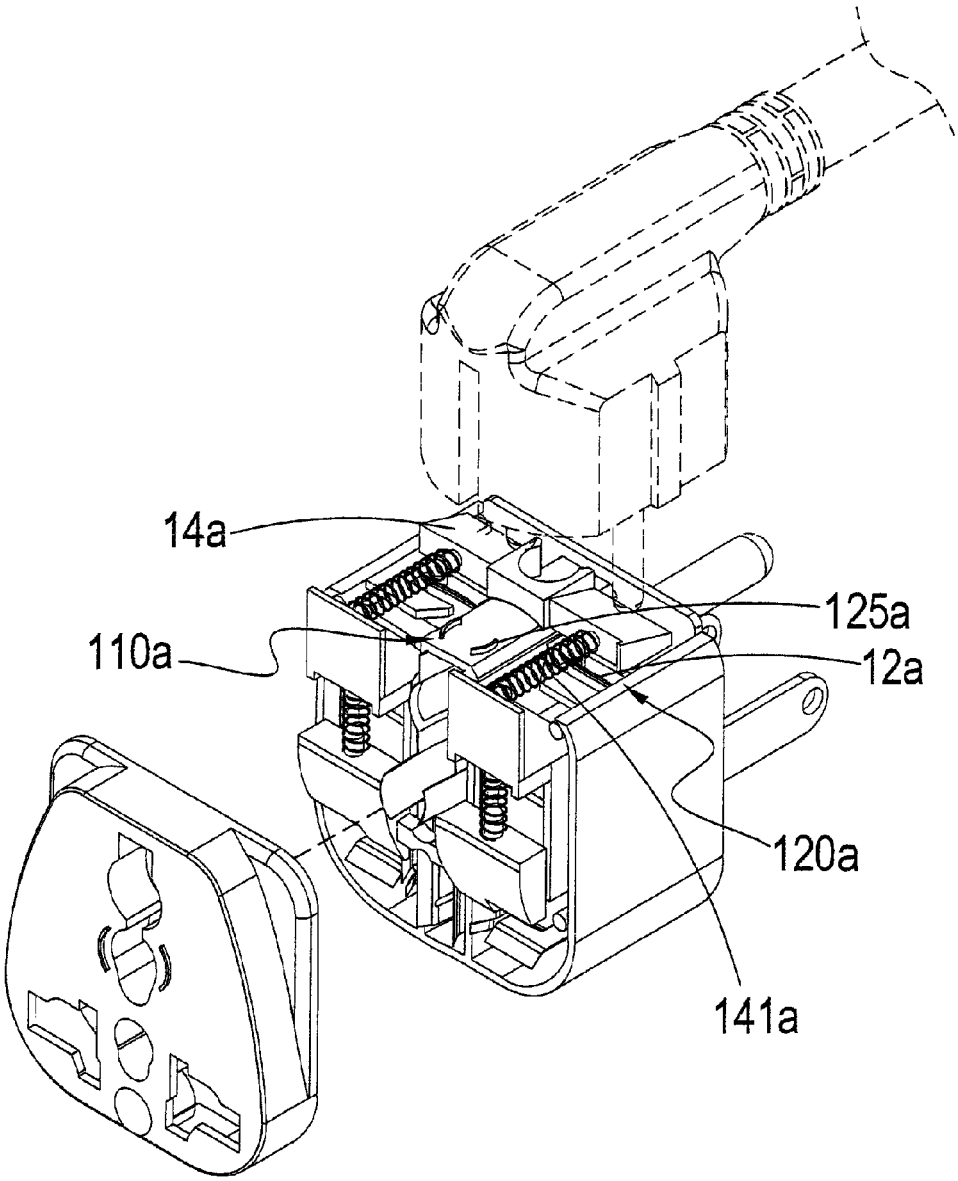
FIG. 6 is a perspective diagram showing a plug properly plugged into the universal plug adaptor of FIG. 5.
Figure 7:
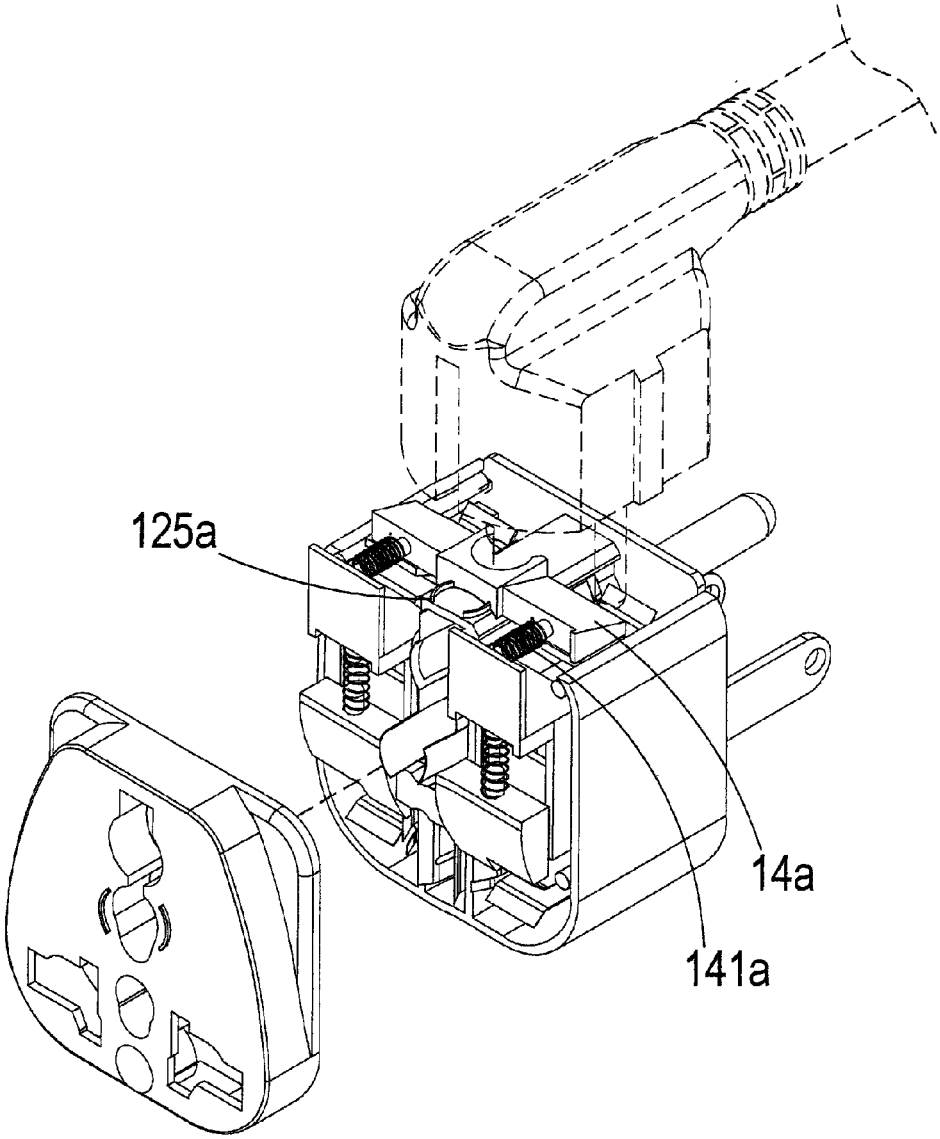
FIG. 7 is a perspective diagram showing the plug of FIG. 6 completely plugged into the universal plug adaptor of FIG. 5.
Figure 8:
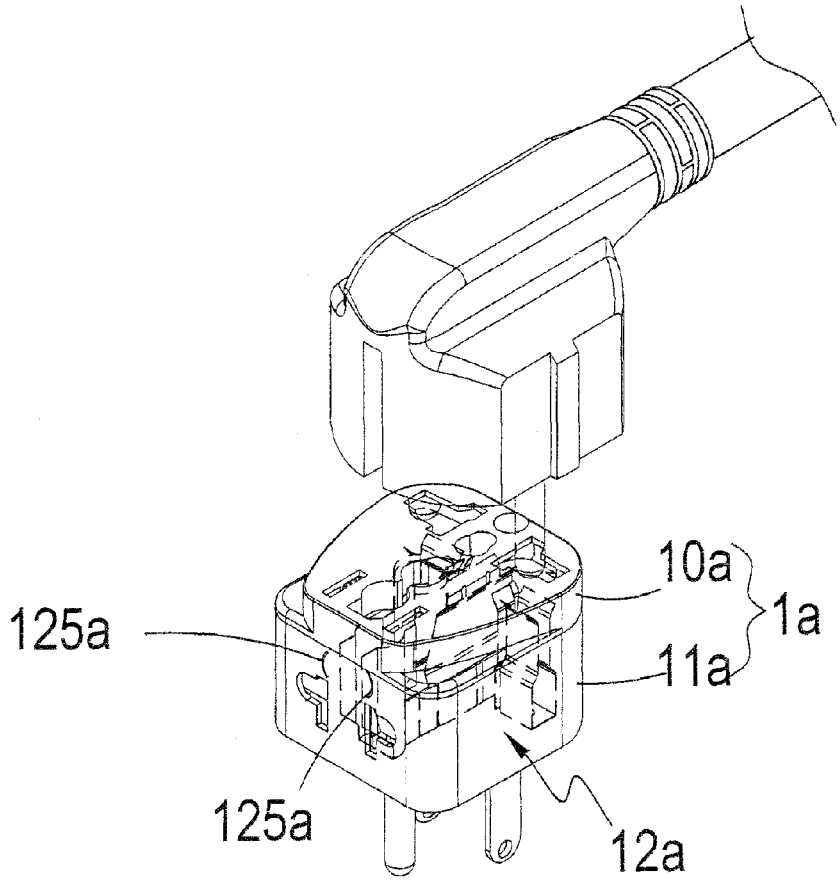
FIG. 8 is a perspective diagram showing a plug to be plugged into a side of the universal plug adaptor of FIG. 5.
Figure 9:
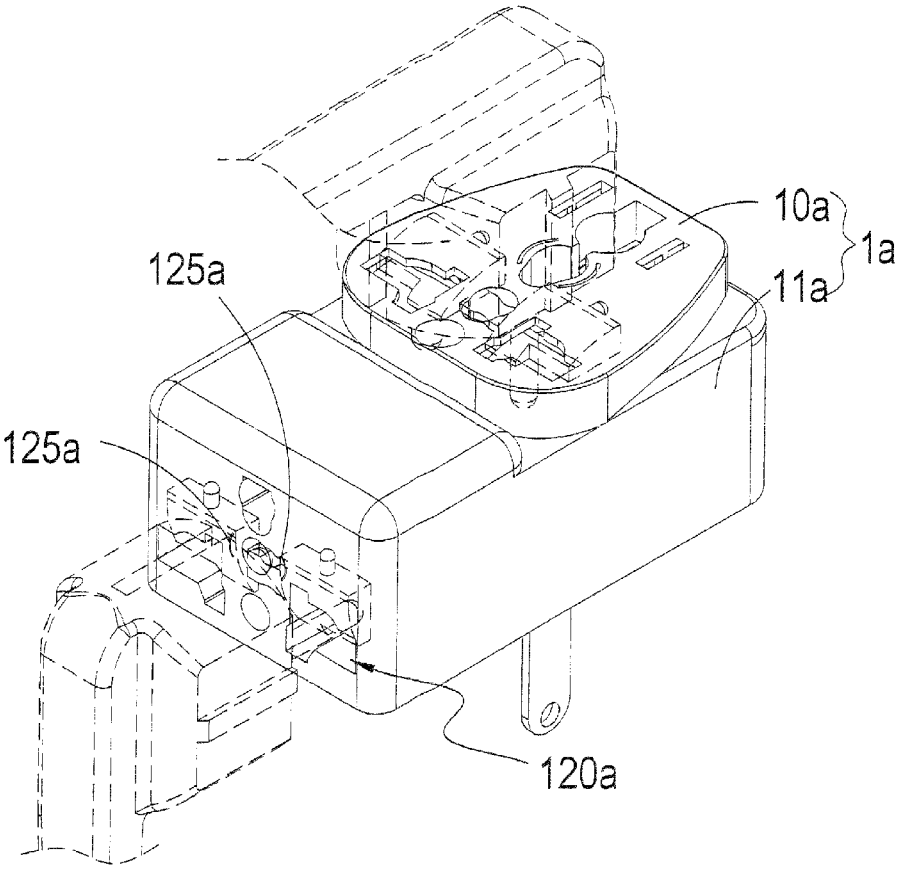
FIG. 9 is a perspective diagram showing two plugs plugged into both sides of the universal plug adaptor of FIG. 5.

As shown in FIG. 1, a universal plug adaptor 1 according to an embodiment of the present invention contains a face plate 10 having a number of plug holes, and a casing 11 joined to the face plate 10. The casing 11 contains the following elements.

A first track element 110 is configured inside the casing 11.

A terminal set 12 is also inside the casing 11. The terminal set 12 contains a live (L) terminal 121, a neutral (N) terminal 122, and a ground (E) terminal 123, corresponding to the various plug holes of the face plate 10.

Two platform elements 13 are configured in the casing 11, each at a lateral side of the first track element 110, and one adjacent to the live terminal 121 and the other the neutral terminal 122.

A first sliding element 14 is configured with two elastic elements 141, each engaged with a platform element 13. The first sliding element 14 has at least a partially curved indentation 140. Each platform element 13 is forwardly extended with a first limiting piece 131 for locking the first sliding element 14 when it is pressured from a side.

As described, the ground (E) terminal 123 has a first ground piece 124 upwardly extended into a through opening 100 on the face plate 10. The first ground piece 124 can be configured as a probe.

The operation of the present embodiment is illustrated in FIGS. 2 to 4H. As illustrated, the universal plug adaptor 1 contains a face plate 10, a casing 11 joined to the face plate 10, and a terminal set 12 inside the casing 11. When an object is inserted into one of the plug holes for the live (L) terminal or neutral (N) terminal, the first sliding element 14 is pressured only from a side and cannot slide along the first track element 110. The first sliding element 14 engages with the first limiting piece 131 on a platform element 13 to prevent electric shock. If it is plug that is plugged into the face plate 10, both elastic elements 141 are pressured and, as such, the first sliding element 14 is balanced and slides along the first track element 110. The prongs of the plug are then in contact with the terminal set 12. Additionally, the ground (E) terminal 123 has a first ground piece 124 upwardly extended into a through opening 100 on the face plate 10 for a plug conforming to the German or French specification. Furthermore, a compulsory ground element 15 is configured on the circumferential wall of the casing 11. The compulsory ground element 15 has a retractable third ground piece 126. No matter how a plug is orientated, it will be properly grounded by the compulsory ground element 15, the third ground piece 126, and the ground (E) terminal 123. The third ground piece 126 and the first ground piece 124 can be configured as probes. As also shown in FIGS. 4A to 4H, the indentation 140 allows a plug conforming to U.S., Taiwan, British, German, French, Swiss, Egypt, Israel, Brazil, or other general specification.

As shown in FIGS. 5 to 9, a universal plug adaptor 1*a* according to another embodiment of the present invention contains a face plate 10*a* having a number of plug holes, and a casing 11*a* joined to the face plate 10*a*. A side member 120*a* is configured to a side inside the casing 11*a*. The side member 120*a* has a terminal set 12*a*. The side member 120*a* further contains a second track element 110*a* and a second limiting piece 131*a*. The second track element 110*a* is slid ably configured with a second sliding element 14*a* engaged with two elastic elements 141*a*. When an object is inserted into the side member 120*a*, the second sliding element 14*a* is pressured only from a side and cannot slide along the second track element 110*a*. The second sliding element 14*a* engages with the second limiting piece 131*a* to prevent electric shock. If it is a plug that is plugged into the side member 120*a*, both elastic elements 141*a* are pressured and, as such, the second sliding element 14*a* is balanced and slides along the second track element 110*a*. The prongs of the plug are then in contact with the terminals of the terminal set 12*a*. Additionally, a second ground piece 125*a* is extended from the terminal set 12*a* into the side member 120*a*. When a plug conforming to the German or French specification is plugged, its prongs are properly connected in terms of polarities.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A universal plug adaptor, comprising a face plate and a casing joined to the face plate; wherein the casing comprises:

a first track element inside the casing;

a terminal set inside the casing where the terminal set contains a live (L) terminal, a neutral (N) terminal, and a ground (E) terminal;

at least two platform elements in the casing, each at a lateral side of the first track element, and one adjacent to the live (L) terminal and the other the neutral (N) terminal;

a side member configured to a side inside the casing where the side member has a terminal set conforming to the German and French plug specification; and a first sliding element configured with two elastic elements, each engaged with a platform element, where the first sliding element has at least a partially curved indentation; and each platform element is forwardly extended with a first limiting piece for locking the first sliding element when it is pressured from a side.

2. The universal plug adaptor according to claim 1, wherein the ground (E) terminal has a first ground piece upwardly extended into the face plate.

3. The universal plug adaptor according to claim 2, wherein the face plate has an opening for receiving the first ground piece.

4. The universal plug adaptor according to claim 1, wherein the side member further contains a second track element and a second limiting piece; and the second track element is slidably configured with a second sliding element.

5. The universal plug adaptor according to claim 1, wherein a second ground piece is extended from the terminal set of the side member into the side member.

6. The universal plug adaptor according to claim 1, wherein a compulsory ground element is configured on the circumferential wall of the casing; and the compulsory ground element has a retractable third ground piece.

7. The universal plug adaptor according to claim 1, wherein the universal plug adaptor is capable of receiving a plug conforming to the German and French plug specification.

* * * * *